US006225544B1

(12) United States Patent
Sciortino

(10) Patent No.: US 6,225,544 B1
(45) Date of Patent: May 1, 2001

(54) MUSIC INSTRUMENT ILLUMINATOR AND POSITIONING AID

(76) Inventor: Kevin Sciortino, 7010 NW. 10th Ct., Margate, FL (US) 33063

( * ) Notice: Subject to any disclaimer, the term of this patent is extended or adjusted under 35 U.S.C. 154(b) by 0 days.

(21) Appl. No.: 09/259,250

(22) Filed: Feb. 26, 1999

(51) Int. Cl.[7] ..... A63J 17/00

(52) U.S. Cl. ..... 84/464 A; 84/464 R; 84/477 R; 84/478

(58) Field of Search ..... 84/464 A, 464 R, 84/477 R, 478

(56) References Cited

U.S. PATENT DOCUMENTS

| | | | | |
|---|---|---|---|---|
| 1,486,585 | * | 3/1924 | Jefferson et al. | 84/177 |
| 3,324,755 | | 6/1967 | Canonico | 84/267 |
| 3,854,370 | | 12/1974 | Saplaski | 84/485 |
| 3,943,815 | * | 3/1976 | Gilbert | 84/293 |
| 4,095,506 | | 6/1978 | Smith | 84/485 R |
| 4,236,191 | | 11/1980 | Martinez | 84/464 A |
| 4,563,933 | | 1/1986 | Kim | 84/262 |
| 4,704,941 | * | 11/1987 | Reilly | 84/464 A |
| 4,745,837 | * | 5/1988 | Rimsa | 84/291 |
| 4,807,509 | | 2/1989 | Graham | 84/314 R |
| 4,890,529 | | 1/1990 | Grant | 84/297 |
| 5,373,768 | | 12/1994 | Sciortino | 84/293 |

* cited by examiner

*Primary Examiner*—Shih-Yung Hsieh
(74) *Attorney, Agent, or Firm*—Brinkley, McNerney, Morgan, Solomon & Tatum, LLP

(57) ABSTRACT

A removably attachable musical instrument and illuminator positioning accessory is disclosed which comprises at least one laser beam emitter which serves to generally illuminate a particular portion of the instrument, and to particularly illuminate the area surrounding the point of contact between the musician's fingers and the instrument.

18 Claims, 8 Drawing Sheets

MUSIC INSTRUMENT ILLUMINATOR AND POSITIONING AID

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

This invention relates generally to musical instruments, and, more particularly, to illuminating musical instruments requiring particular finger or hand placement during operation such as string, percussion and wind instruments, so as to enhance eye and hand coordination; allow the instrument to be played in dark environments; and produce a pleasing aesthetic effect.

2. Description of Related Art

The ability to establish effective eye and hand coordination is one of the first obstacles faced by fledgling musicians. For example, stringed instruments such as guitars, mandolins and ukuleles, required that the musician precisely position his or her fingers at particular points along the fingerboard or neck of the instrument. More experienced or professional musicians typically accomplish this task without having to visually monitor their hand and finger motions; in contrast, beginning musicians fully depend on sight as an essential guide to developing proper techniques. However, all musicians, regardless of the level of experience, depend on sight when performing more challenging routines such as instrument solos and live performance.

One common approach that assists players of transverse stringed instruments is to position a plurality of raised ridges, commonly called frets, along the front face of the fingerboard. The individual strings of the instrument are stretched and extend along the fingerboard over the frets. In effect, the frets serve as reference points about which the musician can position his and her fingers to produce desired notes and chords.

As is generally known, musicians have a penchant for playing in subdued light. Typically, this creates an environment that impedes the musician's ability to visually gauge the proper placement of his or her fingers. Indeed, as regards beginning musicians, the inability to see where to be playing potentially handicaps the progress of learning proper techniques that can later affect performance and concentration or execution.

The prior art is replete with instruments and devices which purport to increase visibility of the guitar neck in dark surroundings. Generally, these instruments and devices provide for either the uniform illumination of the entire fingerboard area, or illumination of predetermined sections or portions thereof. For example, U.S. Pat. No. 5,373,768 issued to the commonly named inventor, discloses a fiber optic strand which provides multiple illuminated points of light along the top surface of the guitar neck. U.S. Pat. No. 3,943,815 issued to Clifford W. Gilbert, discloses fiber optic strands extending through the neck, conducting light through a source located in the body, to illuminate thread markers on the top and threaded surfaces of the guitar neck. U.S. Pat. No. 3,324,755 issued to Lewis Leon Canonico, discloses the guitar having an illuminated neck made of transparent plastic. U.S. Pat. No. 3,854,370 issued to Stanley Sapinski, discloses a fingerboard having light transmitting substraight received in a space between the neck and fingerboard.

All of the prior patents are for illuminating a guitar neck in one manner or another. Generally they are effective for illuminating purposes, but are costly and many require physical alternations to the neck upon installation. In addition, as regards the prior art involving a guitar neck made of transparent plastic, although they tend to conduct light well, they are very heavy in weight, look unappealing, and are very costly in price.

The main problem with the prior systems is that although they generally illuminate guitar necks or fingerboards they do not further particularly illuminate the specific area of contact between a musician's fingers and a fingerboard. This limitation in the prior art is significant because by particularly illuminating a specific area of contact the musician is better able to appreciate the exact positioning of his or her fingers.

Thus, what is needed in the art is a low cost, lightweight, fingerboard illuminator system that provides adequate distribution of light, and enhanced illumination of the particular area of contact between the musician's fingers and the fingerboard. In addition, the illuminator must be easily installed and removed without altering the original condition of the guitar neck while providing minimal obstructive resistance along the guitar neck and body.

While the prior art sets forth various methodologies for illuminating the guitar neck or fingerboard, no prior art is known that provides, either separately or in combination, the teaching or suggestions, or incentive, to make a low cost guitar neck illuminator that provides general illumination for visual reference purposes, and particular illumination of the area of contact between finger and fingerboard, while being light in weight, functional, removable, and not obstructive to the musicians hands.

BRIEF SUMMARY OF THE INVENTION

The present invention is a guitar fingerboard illuminator that addresses the above problems through the use of a light source that is movably attached to the guitar so that the emitted light may be directed along the length of the instrument, particularly the fingerboard portion of the instrument with which the musician interacts during performance. Once installed, the emitted light generally illuminates the interactive portion of the instrument for visual reference purposes while particularly enhancing the illumination of the area immediately surrounding the point of contact between a musician's fingers and the fingerboard.

The light source of the invention comprises a small, lightweight laser beam emitter powered by an internal or external energy source. The laser beam emitter may be positioned anywhere on the instrument's body or neck as long as its emitted beam is directed along the length of the neck or fingerboard. Preferably, the emitter is positioned behind the guitar bridge so that the emitter beam is optically conducted so as to be parallel with or converge upon the fingerboard surface at a small angle relative thereto. In particular, the emitter beam should be directed such that it reflects off the individual frets disposed along the fingerboard, causing them to illuminate and thereby provide a visual reference point for musicians in dark environments. Thus, a primary object of the invention is to provide an inexpensive guitar neck illuminator that is removable and provides for general illumination for reference purposes of the fingerboard area, particularly the frets, as well as enhanced illumination of the area immediately surrounding the point of contact between the musician's fingers and the fingerboard.

Other objects and advantages of this invention will become apparent from the following description taken in conjunction with the accompanying drawings wherein are set forth, by way of illustration and example, certain embodiments in the invention. The drawings constitute a part of the specification and include exemplary embodiments of the present invention and illustrate various objects and features thereof.

In accordance with these and other objects which will become apparent hereinafter, the instant invention will now be described with particular reference to the accompanying drawings.

DETAILED DESCRIPTION OF THE SEVERAL VIEWS OF THE DRAWINGS

DETAILED DESCRIPTION OF THE INVENTION

Figure 1:
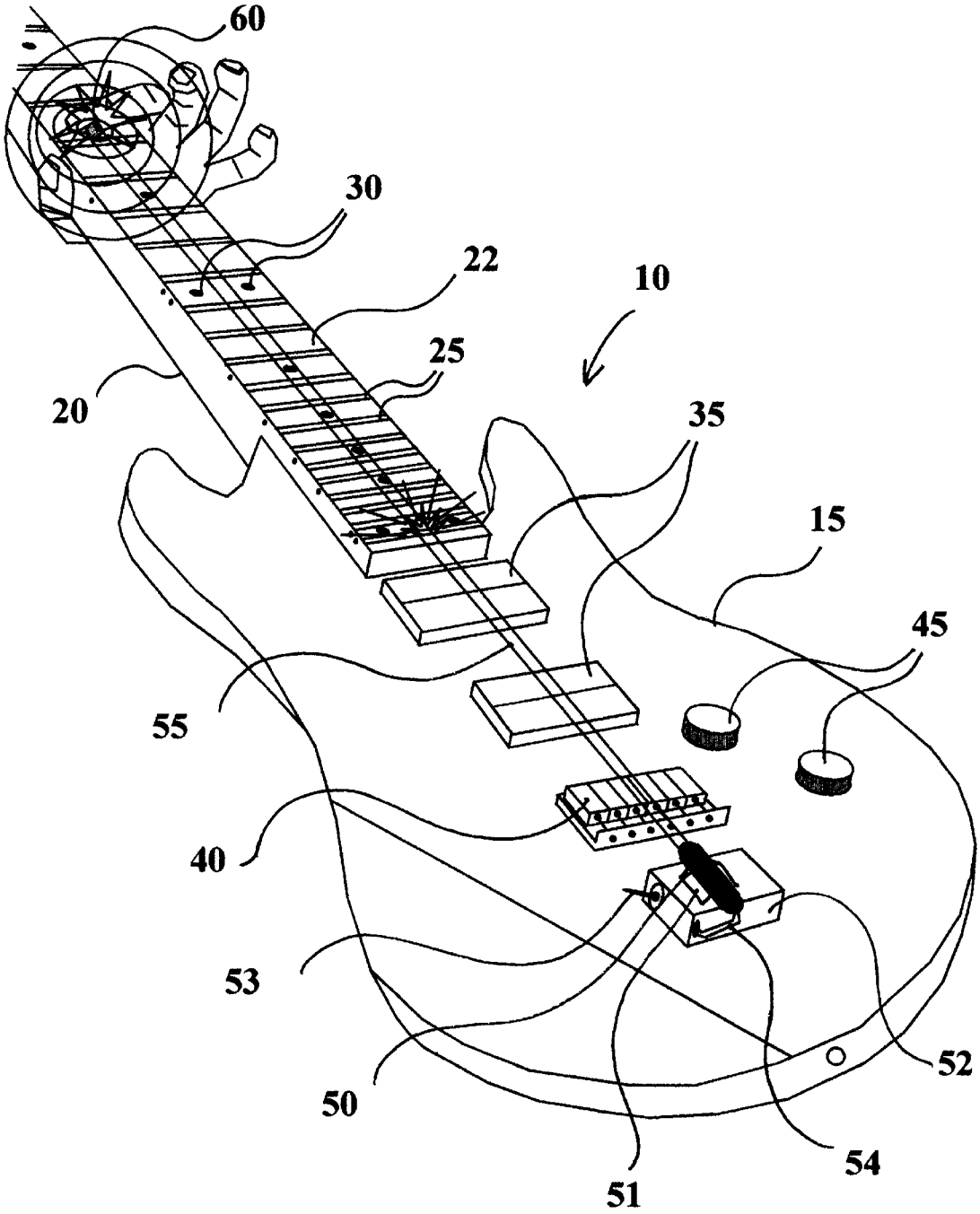
FIG. 1 is a perspective view of an electric guitar embodying the instant invention.

Referring now to the drawings, FIG. 1 illustrates an electric guitar 10 embodying the instant invention. Guitar 10 comprises a main body portion 15 and a neck portion 20 having a fingerboard surface 22 with a plurality of frets 25 and fret markers 30 disposed thereon. Exposed on body portion 15 are pickups 35, bridge 40, knobs 45 and the components of the instant invention. As shown, the preferred embodiment of the present invention broadly comprises a single, lightweight, penlight sized laser beam emitter 50, which is positioned on the main body 15 of guitar 10 by means of harness 51.

Exposed adjacent to emitter 50 is portable power supply 52, which contains a 3 volt DC battery for supplying electric energy to emitter 50. The provision of electric energy to emitter 50 may be selectively controlled by the musician by means of switch 53 associated with power supply 52. As shown, power supply 52 is connected to emitter 50 via wire leads 54; preferably, power supply 52 is positioned so as to not interfere with the musician's performance.

In the alternative, the light source 50 may be powered off of the power source (not shown) to guitar 10.

As shown in FIG. 1, emitter 50 emits a light beam 55 across the length of the guitar's main body and neck. In particular, the beam is directed over bridge 40 and pickup 35 at a predetermined elevation so that it partially reflects off the individual frets 25 disposed along the fingerboard of the guitar. The reflection causes the frets to illuminate and thereby provide a visual reference for the musician when playing in the dark environment.

Figure 2:
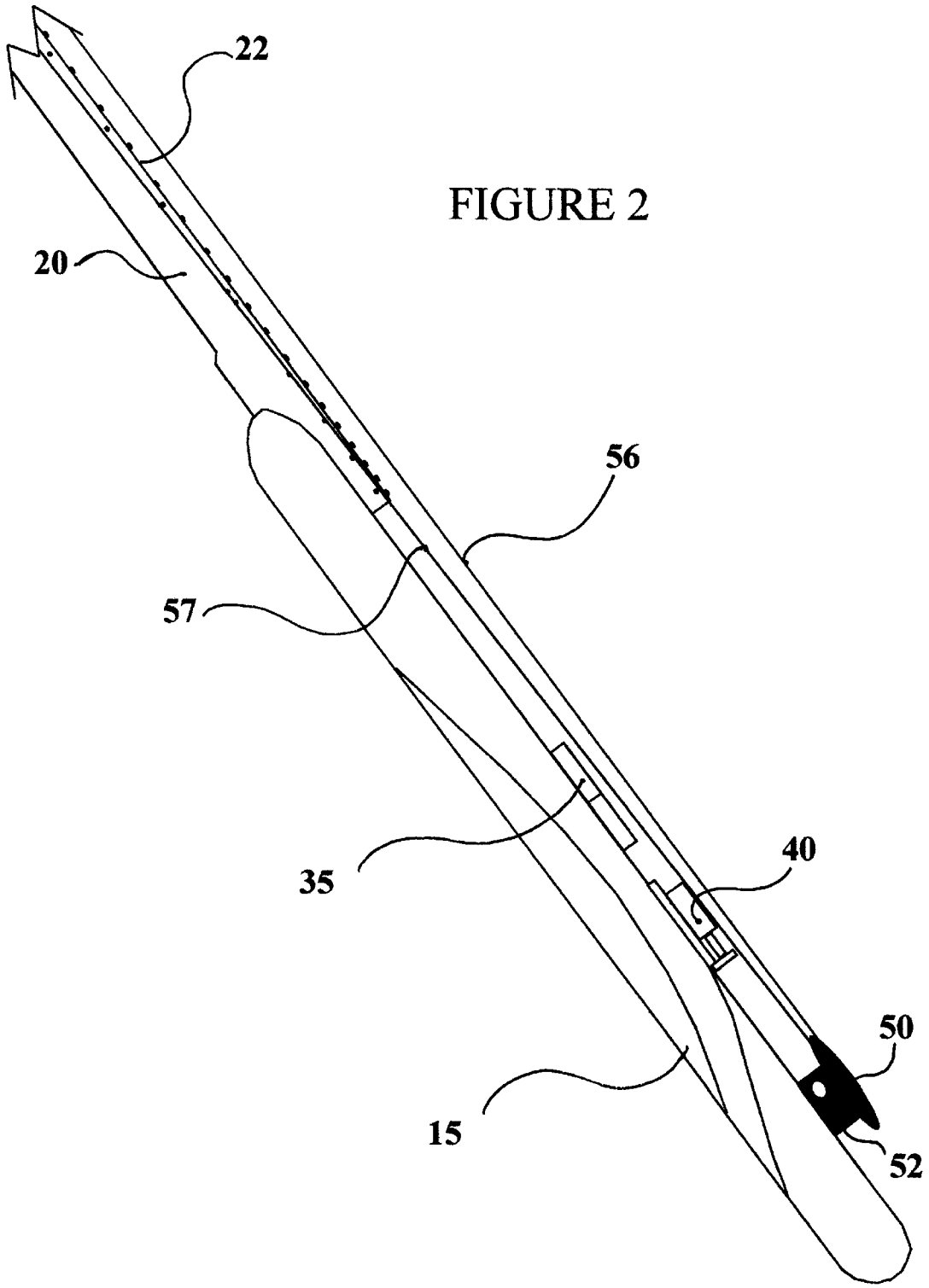
FIG. 2 is a side view of electric guitar embodying the instant invention.

FIG. 2 is a side view of the guitar 10 in FIG. 1. As shown in FIG. 2 and implied in the above description, it is preferred that the elevation of the emitted beam be such that it is not fully impeded by any one individual fret; that is, the beam should be permitted to reflect off of and illuminate all frets disposed along fingerboard 22. Typically, this is best accomplished by adjusting the position of the emitter in a dark environment such that top layer 56 of the beam remains above the fingerboard along the length of the neck, while the bottom layer 57 of the beam converges on the fingerboard.

In addition to illuminating the individual frets, the emitter beam 55 also functions to particularly illuminate the area immediately surrounding the point of contact between the musician's fingers and the fingerboard, as shown in FIG. 1. This aspect of the invention is not found in the prior art cited above and further enhances the visual reference function served by the instant invention.

Figure 3:
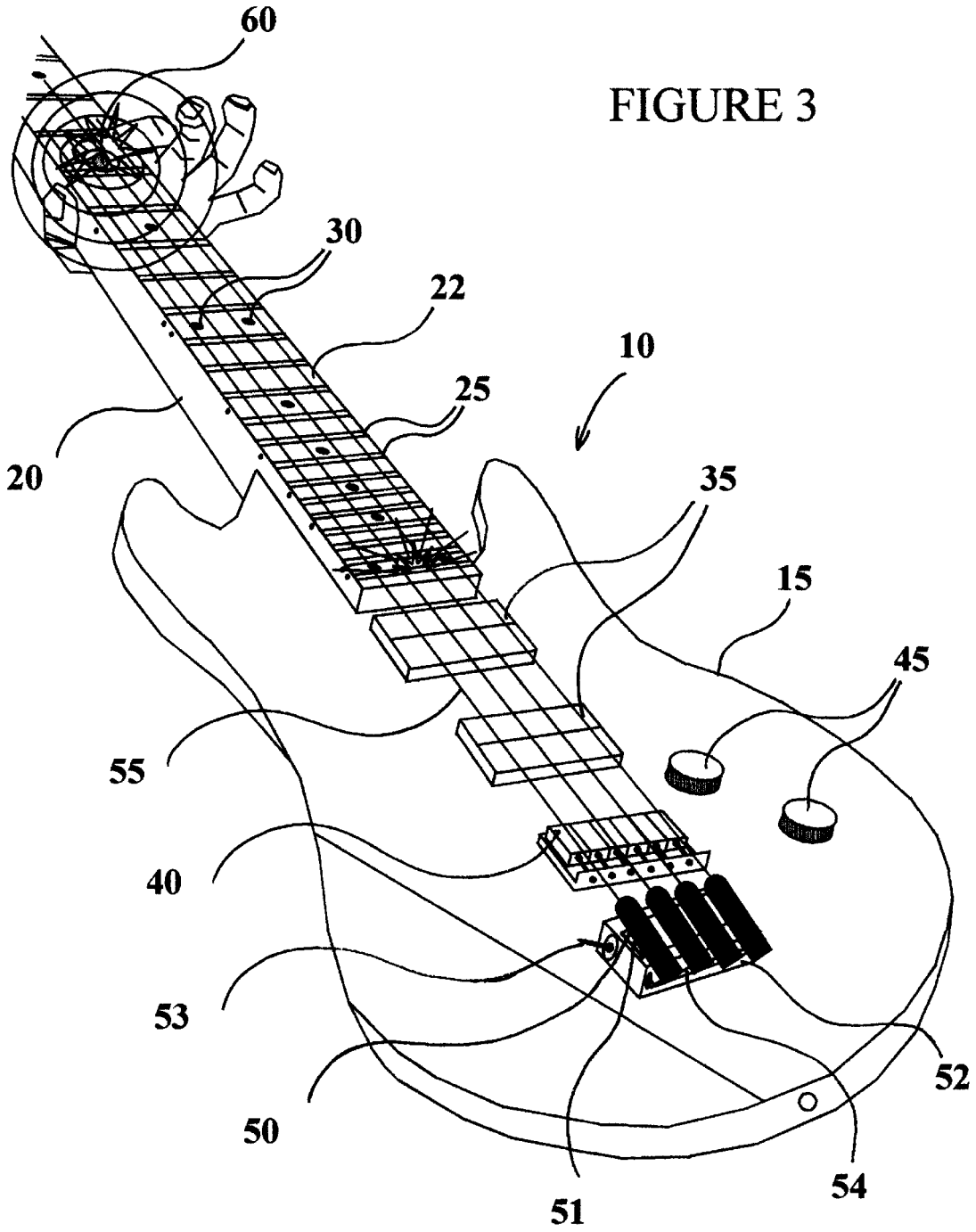
FIG. 3 is a perspective view of an electric guitar embodying an alternative embodiment of the instant invention.

FIG. 3 is a perspective view of the guitar of FIG. 1 having an alternative embodiment of the invention disposed thereon. Specifically, the invention described above may comprise a plurality of laser beam emitters as shown in FIG. 3. In particular, the layout of FIG. 3 is such that there is one emitter per guitar string so as to provide better coverage and illumination of the neck and fingerboard area. Furthermore, it may be appreciated that the individual emitters need not be positioned as shown in FIG. 3; that is, they may be positioned at randomly selected points along the guitar so long as the individual beams are properly directed along the length of the fingerboard.

Figure 4:
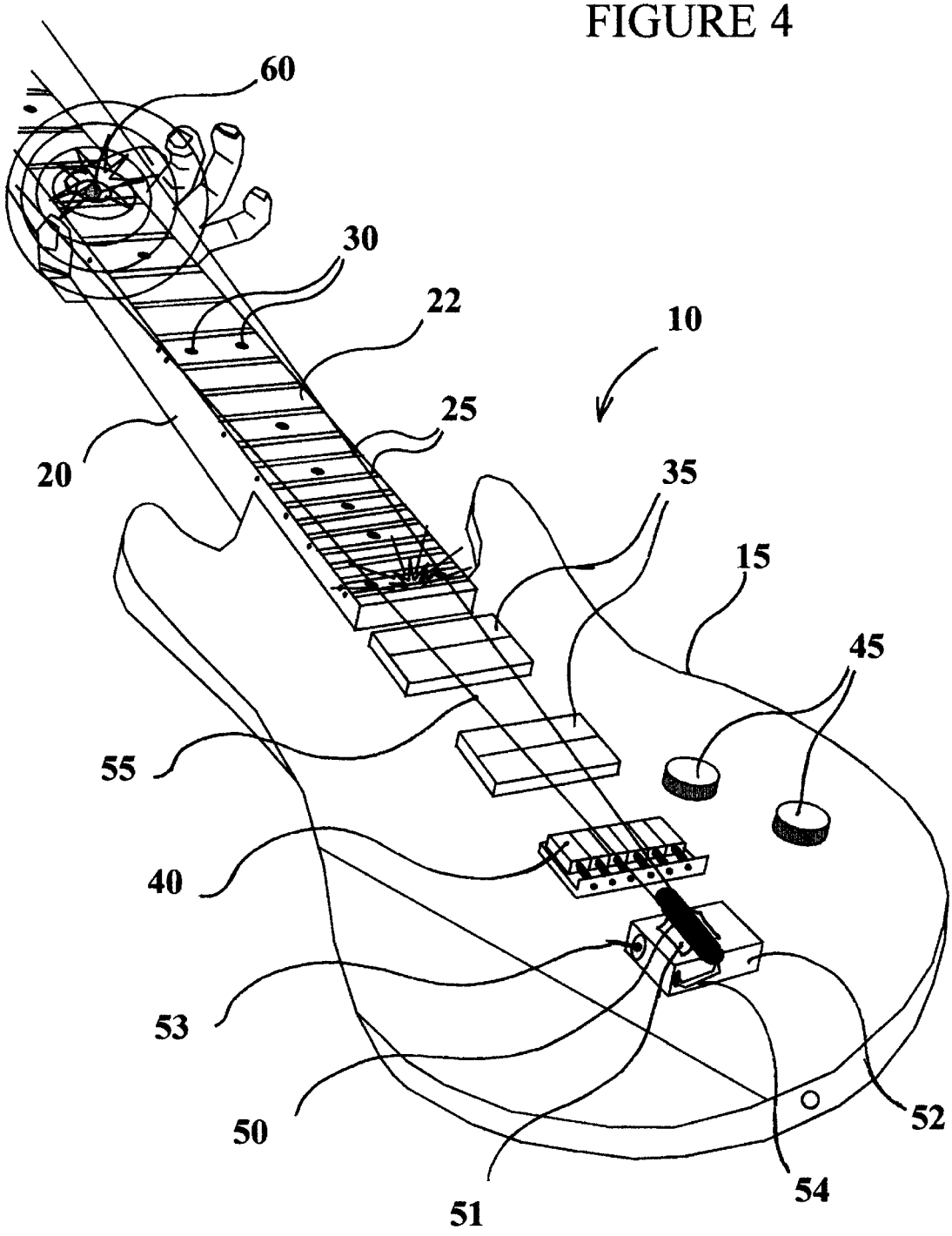
FIG. 4 is a perspective view of an electric guitar embodying an alternative embodiment of the instant invention.

FIG. 4 is a perspective view of the guitar in FIG. 1 having yet another alternative embodiment of the invention disposed thereon. As shown in FIG. 4, the beam emitted is diffused so as to better cover and illuminate the fingerboard area. Specifically, this is accomplished by equipping emitter 50 with means for optically modulating emitter beam 55. It is preferred that optical modulating means (not shown) comprise a light diffusing device such as transparent/translucent sheet material having the ability to partially block or diffuse light passing therethrough. Preferably, the light diffusing device is positioned at the source point of beam 55 so as to serve as a lens through which the beam passes. This particular embodiment serves as a cheaper alternative to the use of the plurality of emitters as shown in FIG. 3.

As will be apparent to those skilled in the music art, most standard electric or acoustic guitars have 6 strings with a plurality of frets disposed along the fingerboard. However, an electric or acoustic 12 string guitar or 4 string bass can be substituted equally well without departing from the spirit or scope of the invention. Furthermore, the present invention can also be utilized with mandolins, banjos, sitars, violins, as well as many other stringed instruments. The present invention may also be utilized with string instruments having no fret markers and other non-traditional string instruments. In particular, there are instruments which are now being manufactured having a neck portion and different fret positions along the neck which do not have any strings. These instruments operate by being sensitive to the touching of the neck by the fingers of the artist. Different positions along the neck of these instruments create different notes when touched. It is readily apparent that the present invention can be utilized if such instrument is hand positioned and a dark surrounding is still a major concern of the artist. A standard 6 string electric guitar neck is shown only as a presentation model for understanding the principle of application for the neck illuminator invention.

It may be appreciated by one skilled in the art that the instant invention may also be used with other musical instruments such as drums, keyboards, pianos and wind instruments. In each case, the above-described benefits and use of the instant invention are similarly applicable and realized.

Figure 5:
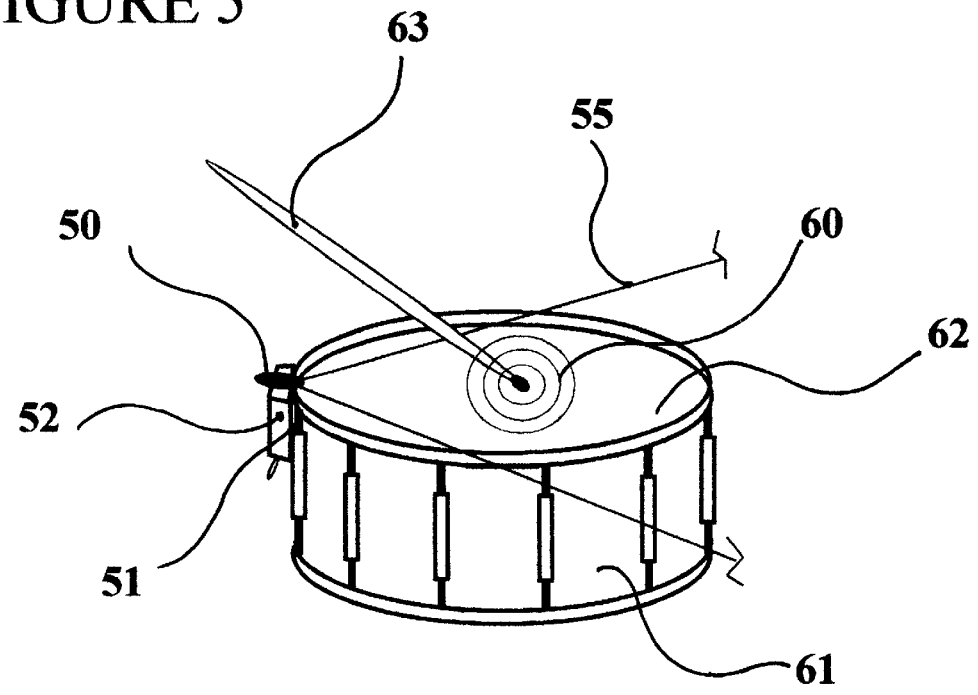
FIG. 5 is a perspective view of a representative drum embodying an alternative embodiment of the instant invention.
Figure 6:
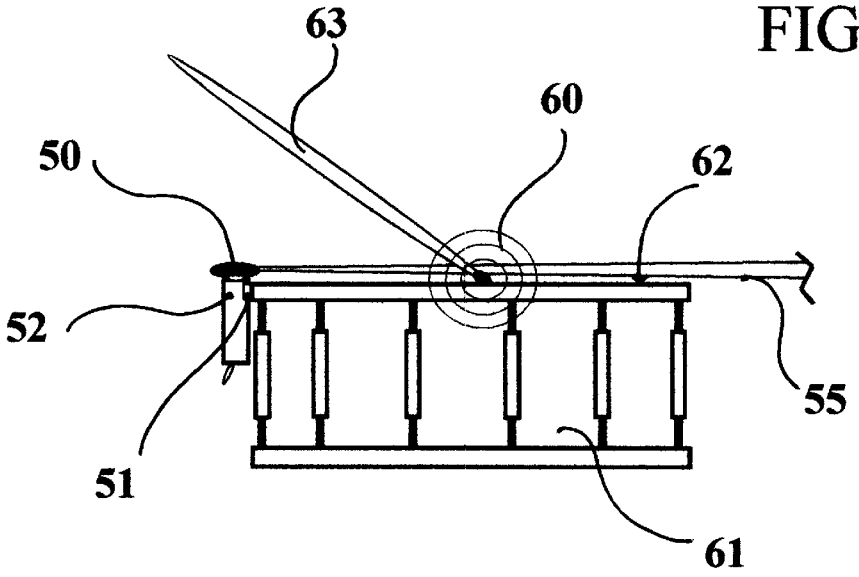
FIG. 6 is an elevational view of the drum of FIG. 5.

For example, in the case of drums, the light emitter may be positioned so that its beam is directed along the top surface of the drum head such that when the musician strikes the drum with his or her hand or a drumstick, the point of contact will illuminate in the same manner as the musician's fingers in the above-descried guitar embodiment. FIGS. 5 and 6 show a representative drum utilizing the instant invention in which a drum shell or body 61 and drum head 62 connected thereto cooperate with a laser beam emitter 50, which is attached to drum body 61 by means of harness 51. Alternately, the emitter 50 may be connected to the drum by any other connector which would occur to one skilled in the art, such as a bracket, hook and loop fastener, or adhesive. The emitter is associated either wirelessly or by wires with a power supply 52 to permit emitter 50 to emit a generally focused beam 55 in the proximity of, and at least somewhat parallel to, the drum head 62.

Figure 7:
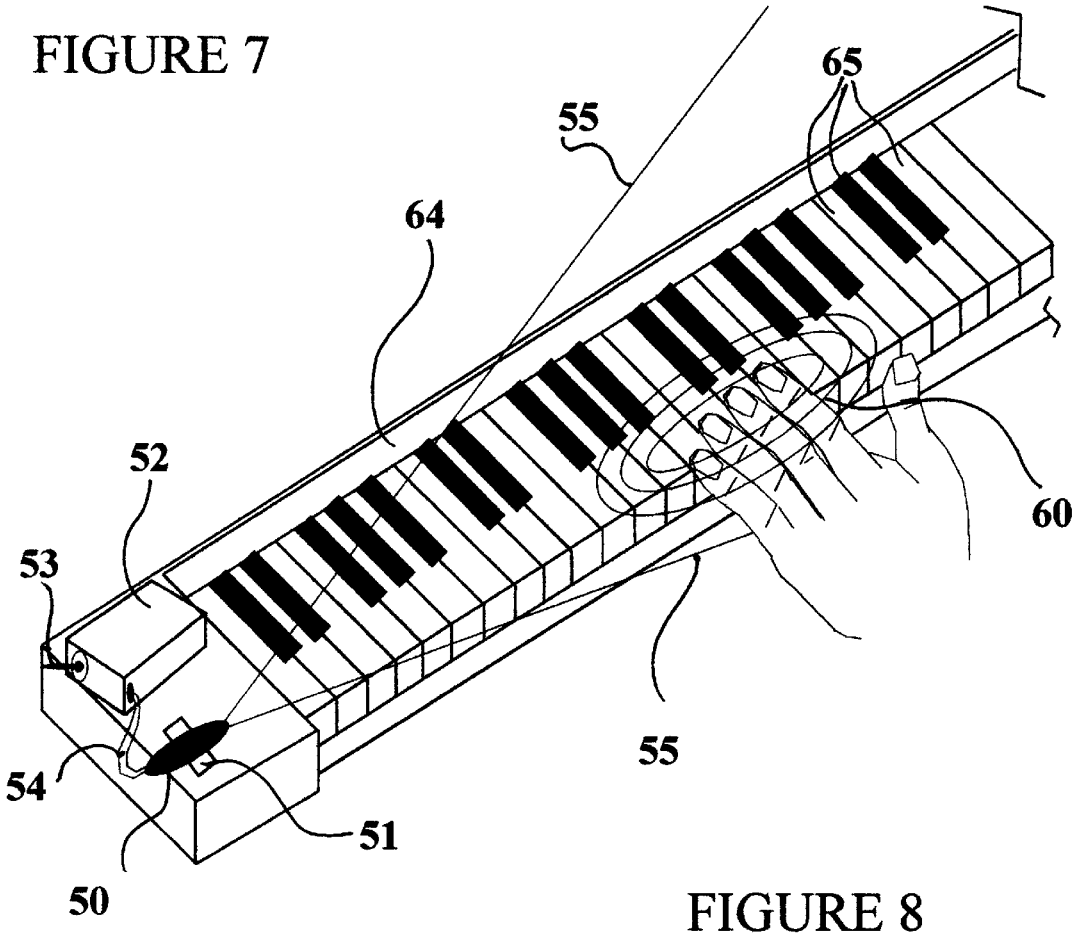
FIG. 7 is a perspective view of a representative keyboard instrument embodying an alternative embodiment of the instant invention.
Figure 8:
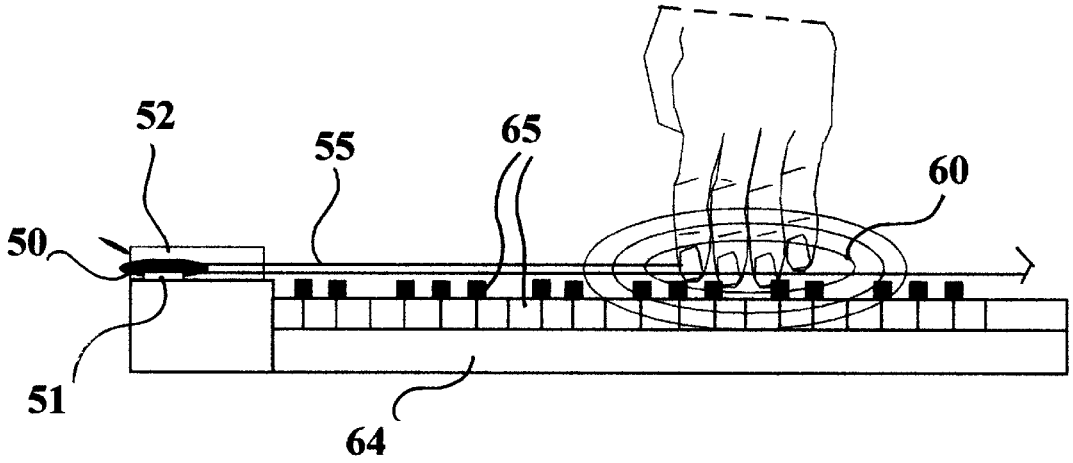
FIG. 8 is an elevational view of a representative keyboard instrument of FIG. 7.
Figure 9:
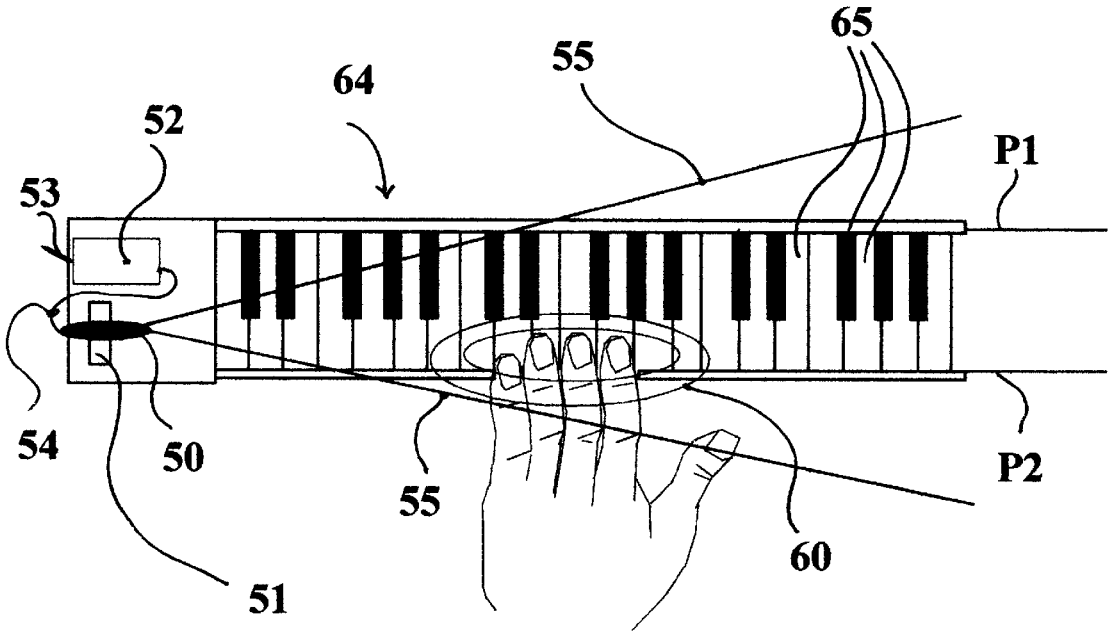
FIG. 9 is a top plan view of the representative keyboard instrument of FIG. 7.

In the case of a keyboard instrument, such as a piano or synthesizer, the emitted beam may be directed across the entire length of the keyboard so that the musician's fingers will illuminate during depression of the individual keys in the same manner as the musician's fingers in the above-descried defined embodiment. FIGS. 7–9 show a generalized representation of a keyboard instrument 64 having keys 65 and a laser beam emitter 50 connected thereto. A power supply 52 is connected either wirelessly or by wire connection 54, and emitter 50 is mounted to keyboard instrument 64 via a connector 51. Connector 51 may be any apparatus which would occur to one of skill in the art, including but not limited to a rigid bracket, hook and loop fastener, adhesive, and the like. A switch 53 may be used to energize and de-energize emitter 50. As can be seen, emitter 50 emits a beam of light 55 generally above and parallel to the keys 65 which, when depressed by the fingers of a user create an illumination effect 60.

Figure 10:
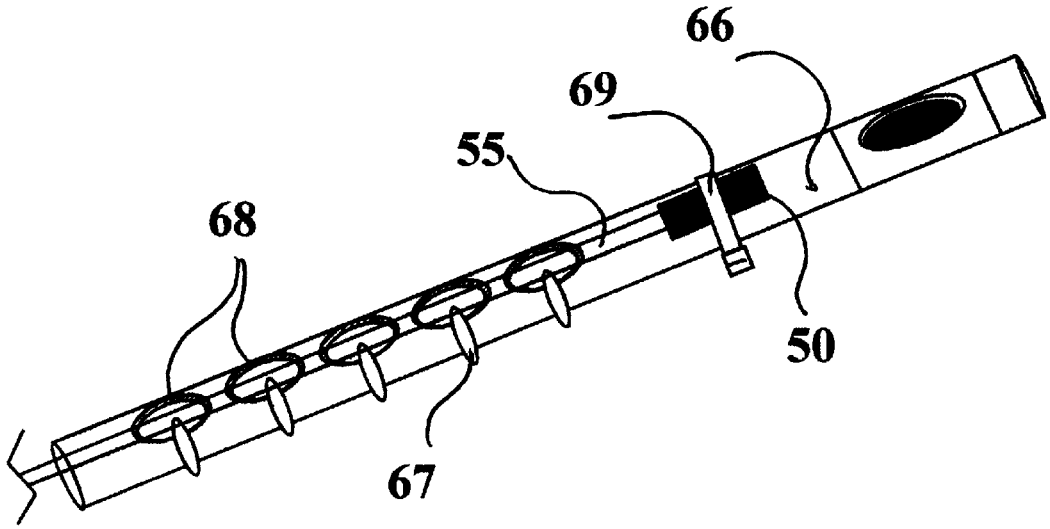
FIG. 10 is a perspective view of a representative wind instrument embodying an alternative embodiment of the instant invention.
Figure 11:
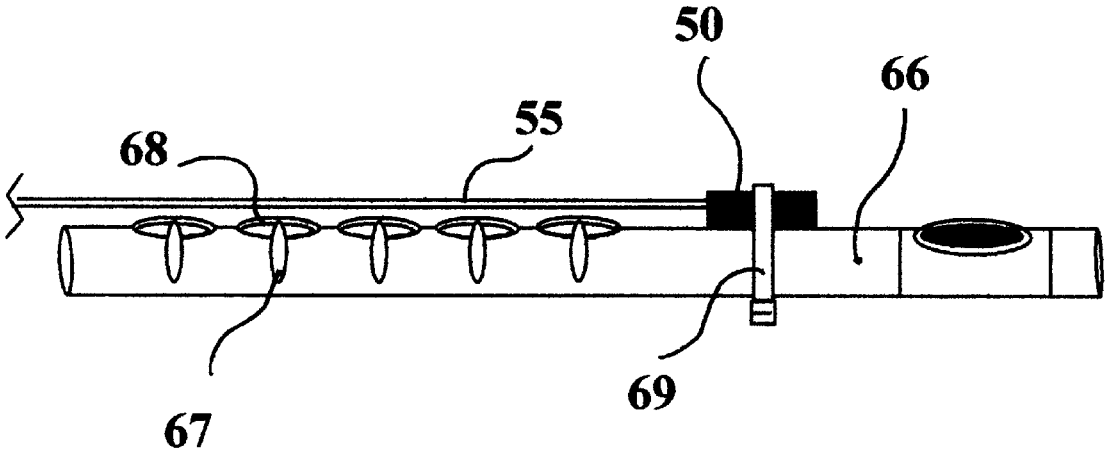
FIG. 11 is an elevational view of the representative wind instrument of FIG. 9.

As for wind instruments, the emitted beam may be directed over the finger holes of a flute, or over the valves of a horn or trumpet. In either case, the emitted beam will illuminate the particular placement of the musician's fingers in the same manner as the guitar embodiment disclosed above. FIGS. 10 and 11 show a representative wind instrument 66 having a plurality of player keys 67 covering apertures 68. A laser beam emitter 50 and power supply 52 are connected to the wind instrument by any convenient means which will occur to one of skill in the art such as by bundling strap 69 shown, or via a bracket, hook and loop fastener, adhesive, or the like. Beam 55 is emitted by emitter 50 generally parallel to and above keys 67 and apertures 68 in such a way that the keys and/or fingers of the person playing instrument 60 come into contact with beam 55 to create an illumination effect.

It may be appreciated by one skilled in the art that the above-described alternative embodiments regarding the use of a plurality of emitters, as well as that regarding optical modulating means, may be similarly utilized in the above drum, piano and wind instruments discussed above.

In summary, an attachable and removable musical instrument illuminator accessory is disclosed which contains means for generally illuminating a particular portion of the instrument, and particularly illuminating the area surrounding the point of contact between the musician's fingers and the instrument, thereby allowing the instrument to be played in a dark or dim surrounding, and, at the same time, adding to the aesthetic appeal of the instrument without significantly increasing its cost or physically altering its original condition.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A removably attachable illumination apparatus for string instruments having a body portion and a fingerboard with a plurality of frets disposed thereon, said apparatus comprising:

(a) a light source means for producing a light beam directed over and substantially parallel to said fingerboard, said light beam serving to particularly illuminate an area surrounding a point at which a finger contacts said fingerboard, and to reflect off said plurality of frets to provide general illumination thereof;

(b) means for mounting said light source means on said string instrument;

(c) means for supplying power to said light source means.

2. The illuminating apparatus of claim 1 wherein said light source means includes a least one laser beam emitter.

3. The illuminating apparatus of claim 1 wherein said light source means further comprises means for at least partially diffusing said light beam so as to substantially illuminate said fingerboard and said plurality of frets.

4. The illuminating apparatus of claim 1 wherein said mounting means includes a selectively positioned flexible wire harness.

5. The illuminating apparatus of claim 1 wherein said mounting means for supplying power includes D.C. energy cell.

6. A removably attachable illuminating apparatus for drum sets having a drum shell with a drum head attached thereto, said drum set playable by hand or by drumstick, said apparatus comprising;

(a) light source means for producing a light beam directed over and substantially parallel to said drumhead, said light beam serving to particularly illuminate an area surrounding a point at which a musician's hand or drum stick contacts said drumhead, and to generally illuminate said drum head;

(b) means for mounting said light source means on said drum set;

(c) means for supplying power to said light source means.

7. The illuminating apparatus of claim 6 wherein said light source means includes at least one laser beam emitter.

8. The illuminating apparatus of claim 7 wherein said light source means further comprises means for at least partially diffusing said light beam so as to substantially illuminate said drumhead.

9. The illuminating apparatus of claim 6 wherein said mounting means includes a selectively positioned flexible wire harness.

10. The illuminating apparatus of claim 6 wherein said means for supplying power includes D.C. energy cell.

11. A removably attachable illuminating apparatus for keyboard instruments having a keyboard with a plurality of keys disposed thereon, said apparatus comprising;

(a) at least one laser beam emitter for producing a light beam directed over and substantially parallel to said keyboard, said light beam serving to particularly illuminate an area surrounding a point at which a finger contacts said keys, and to generally illuminate said keyboard;

(b) means for mounting said light source means on said keyboard instrument;

(c) means for supplying power to said light source means;

(d) the emitter being mounted to said keyboard between parallel planes defined by front and rear surfaces of said keys.

12. The illuminating apparatus of claim 11 wherein said light source means further comprises means for at least partially diffusing said light beam so as to substantially illuminate said keyboard.

13. The illuminating apparatus of claim 11 wherein said means for supplying power includes D.C. energy cell.

14. A removably attachable illuminating apparatus for wind instruments having a fingering portion with a plurality of valves or finger holes disposed thereon, said apparatus comprising;

(a) light source means for producing a light beam directed over and substantially parallel to said plurality of valves or finger holes, said light beam serving to particularly illuminate an area surrounding a point at which a finger contacts said valves or finger holes and to generally illuminate said plurality of valves or finger holes;

(b) means for mounting said light source means on said wind instrument;

(c) means for supplying power to said light source means.

15. The illuminating apparatus of claim 14 wherein said light source means includes at least one laser beam emitter.

16. The illuminating apparatus of claim 15 wherein said light source means further comprises means for at least partially diffusing said light beam so as to substantially illuminate said plurality of valves or finger holes.

17. The illuminating apparatus of claim 14 wherein said mounting means includes a selectively positioned flexible wire harness.

18. The illuminating apparatus of claim 14 wherein said power energy means includes D.C. energy cell.

* * * * *